United States Patent [19]

Löjdström

[11] Patent Number: 4,913,766

[45] Date of Patent: Apr. 3, 1990

[54] STRIP APPLICATOR

[76] Inventor: Börje Löjdström, P.O. Box 1651 Vij, S-827 00 Ljusdal, Sweden

[21] Appl. No.: 299,929

[22] Filed: Jan. 23, 1989

[51] Int. Cl.[4] ..... B32B 31/18

[52] U.S. Cl. ..... 156/523; 156/527; 156/574; 156/576; 156/577; 156/579

[58] Field of Search ..... 156/523, 527, 574, 576, 156/577, 579

[56] References Cited

U.S. PATENT DOCUMENTS

| | | | |
|---|---|---|---|
| 851,615 | 4/1907 | Coe | 156/577 |
| 2,097,660 | 11/1937 | Gordon | 156/576 |
| 2,607,508 | 8/1952 | Clampitt | 156/527 |
| 3,575,771 | 4/1971 | Padgett | 156/523 |
| 4,555,298 | 11/1985 | Boucher | 156/523 |
| 4,806,184 | 2/1989 | Shannon | 156/523 |

*Primary Examiner*—Caleb Weston

*Attorney, Agent, or Firm*—McFadden, Fincham, Marcus & Allen

[57] ABSTRACT

There is disclosed a strip applicator for dispensing and applying a strip from a roll thereof for covering joints or the like in wallboard or ceiling boards. The applicator has a main frame, a spaced-apart upper handle member and a spaced-apart lower roll mounting member, each being positioned in a spaced-apart planar relationship. The frame has first means for mounting the handle member in a first plane displaced from the frame member, and second means for mounting the roll mounting member in a plane displaced from and opposite to the plane of the handle member. Strip guiding means are mounted by the frame in operative relationship to the second mounting means, the strip guiding means are adapted to receive a strip from a roll thereof mounted on the lower roll mounting member and to guide the strip from the lower roll mounting member to and past the frame member whereafter the strip is adapted to be placed into juxtaposition with a joint between adjacent boards by the applicator roller. Severing means mounted by the frame member are adapted to sever the strip between the frame member and the lower roll mounting member, the severing means including cutting means mounted for reciprocal movement relative to the frame along a path substantially parallel to the frame.

11 Claims, 3 Drawing Sheets

STRIP APPLICATOR

BACKGROUND OF THE INVENTION

This invention relates in general to strip applicators for dispensing and applying a strip from a roll thereof. More particularly, this invention relates to a manually operated device for applying a strip over a joint between adjacent boards, (e.g. plasterboards) in walls as well as ceilings.

DESCRIPTION OF RELATED ART

When finishing a surface of a wall or ceiling built from boards, such as plasterboards or wall boards, in order to make the wall or ceiling suitable for painting or wall paper hanging, the joints between adjacent boards have to be covered by some type of strip so as to avoid future cracks in the paint coat or wall paper. Previously, the strips for this purpose always consisted of some sort of adhesive tape which can, by itself, adhere to a surface, but today, professionals more and more prefer to use paper webs which, per se, have no adhesive and which are attached to the wall or ceiling surface by direct adherence to fresh putty applied at the joints between boards.

Strip applicators for application of adhesive tapes are known in the prior art. Thus, U.S. Pat. No. 3,575,771 to PADGETT discloses an applicator including a frame connected to an elongated handle which can be held by an operator, means on the frame for rotatably supporting a supply roll of reticular, adhesive tape, an applicator roller for pressing the tape against a wall surface, means for guiding the tape from thesupply roll to the applicator roller and a cutter mechanism for cutting off the tape. In the arrangement illustrated, in U.S. Pat. No. 3,575,771, the handle member, roll mounting member and the applicator are all in the same general plane and basically form a sequential and continuous unit. By having all of the components in line, limitations arise for application of different types of tapes and in construction of the device. In addition, this device is complicated, having many interrelated parts making the same expensive to manufacture. The cutter mechanism operates in a plane which is perpendicular to the longitudinal axis along which the frame as well as the handle extend. Also, the cutting blade is movable into contact with a freely running part of the tape by means of a lever which is pivotally connected to the frame by a transverse pin and has a rearward portion or handle extending at an acute angle to the applicator handle extending rearwardly from the frame. In many cases, the ceilings of rooms are located at a relatively high level above the floors (often in the range of 3 to 5 meters) and irrespective of whether the applicator is used for applying tape to a wall or the ceiling, this means that the applicator handle has to be fairly long. This in turn means that the handle of the lever has to be long in order to make it possible for the operator to grip the same and since the lever handle extends at an angle in relation to the main handle, the handle lever has to be moved a long distance by the operator when the tape is to be cut off. The result of this is not only that the applicator will be clumsy and difficult to operate, but also that the cutter blade moves rather slowly and in combination with the fact that the blade does not co-operate with any type of edge member severe problems may arise when a flexible and usually rather tenacious tape is to be cut off.

Another disadvantage of this applicator is that the applicator roller is located along the same axis which is common to the frame as well as the main handle, also the guiding means for the tape are located on a level above the applicator roller as well as the tape supply roll. This means that the operator has to start the application of the tape at the bottom of a wall and finish the application at the top thereof. Since the distance between the operator and the top of a high wall may be considerable, the operator may run into difficulties when the strip is to be cut-off at a precise spot at the top of the wall, especially if the cutting blade is not capable of sharply, cleanly and rapidly cutting off the tape.

Another previously known tape applicator is shown in U.S. Pat. No. 4,555,298 to BOUCHER. In Boucher, a handle member is provided which directly mounts a roll holding component extending from the handle and in the same plane and terminates in a roller applicator, again in the same general plane as the handle member and the roll holding component. This leads to certain disadvantages in attempting to use such a device for high level work and further, to a relatively complicated construction in attempting to form a "compact" structure. In addition, in this applicator the cutter mechanism does not operate perpendicularly to the frame, but parallel thereto. Thus the cutter mechanism of BOUCHER includes a blade or knife which is located at the very foremost end of the frame and which is normally held in an idle, retracted position by means of a pawl at the same time as spring means are compressed and urge the blade towards a projecting, cutting position. By means of an operating rod extending to the rearward end of a main handle, the pawl can release the cutting blade so as to be pushed by the spring means into contact with the tape. Also, in this case the cutting blade does not cooperate with any type of edge member and therefore problems may arise with having tenacious tape properly cut off. In view of the fact that the blade is springloaded in its idle position, accidents may occur if the blade is unintentionally triggered. Another disadvantage with this device is that the cutting blade is positioned, not between the tape supply roll and the applicator roller, but after the latter. This means that the applicator roller will have to pass the corner between a wall and a floor before the tape can be cut off properly and in practice this is difficult to perform.

SUMMARY OF PRESENT INVENTION

It is an object of the present invention to overcome the above mentioned disadvantages of the previously known applicators and to provide a strip applicator which is easy to handle and economical to manufacture.

Another object is to provide an applicator which can be used for applying not only adhesive tape, but also other types of desired strips, such as paper webs.

Another object is to provide an applicator which is capable of rapidly, sharply and cleaning cutting off the strip irrespective of whether this consists of a paper web or an adhesive tape.

Still another object of the invention is to provide an applicator having a cutter mechanism which can be used not only for cutting off the strip, but also to gently hold the strip when starting the application of the strip on a surface so as to make it possible for the operator to commence the application and in conjunction therewith to properly direct the strip along a rectilinear joint between two adjacent boards.

Still another object of the invention is to provide an applicator which can be moved downwardly from a ceiling to the floor along a wall.

An object is also to provide an applicator the cutter mechanism of which can not be unintentionally released.

According to a first embodiment of the present invention there is provided a strip applicator for dispensing and applying a strip from a roll thereof comprising (a) a main frame (b) a spaced-apart upper handle member and (c) a spaced-apart lower roll mounting member, the main frame having first means for mounting the handle member in a first plane displaced from the main frame, the main frame further including second means for mounting the roll mounting member in a plane displaced from and opposite to the plane of the handle member, the handle member including an applicator roller disposed in operative relationship at one end of the handle member, to the roll mounting member, strip guiding means mounted by the main frame in operative relationship to the second mounting means, the strip guiding means being adapted to receive a strip from a roll thereof mounted on the lower roll mounting member and to guide the strip from the lower roll mounting member to and past the main frame whereafter the strip is adapted to be placed into juxtaposition with a joint between adjacent boards by the applicator roller, and severing means mounted by the main frame adapted to sever the strip between the main frame and the lower roll mounting member, the severing means including cutting means mounted for reciprocal movement relative to the main frame along a path substantially parallel to the main frame.

According to another aspect of the present invention, there is provided a strip applicator for dispensing and applying strips from rolls, comprising: an elongated frame having means for connecting the same to an elongated handle, one end of which can be held by an operator and the opposite end of which has means for holding an applicator roll provided to roll and press the strip, during use, into final position covering a junction between two adjacent boards, the connecting means locating the frame in the area under the handle, means for holding an axle onto which a roll of strip can be received and kept rotatable in the area under the frame, means for guiding the strip from the roll past a forward end of the frame to the applicator roller, and a cutting means for cutting the strip, including a blade mounted for reciprocation relative to the frame along a path being substantially parallel to the frame, more particularly between a first idle position in which the blade by means of a spring is retracted and spaced from an edge member to allow free feeding of the strip from the roll to the guiding means and a second forward position in which a forward edge thereof is moved into contact with the edge member so as to cut off the strip and including an operating rod extending parallel to the main handle and rearwardly from the frame so as to make it possible to push the cutting blade from the ideal position towards the edge member against the action of the spring.

In further explanation of the invention, a strip applicator in one form includes three spaced apart components in the form of a main frame, a handle member and a roll mounting member with the main frame being centrally positioned between the handle member and the roll mounting member. The handle member functions to permit manual gripping of the device for use and serves to mount an applicator roll at one end thereof, which is positioned in a leading plane relative to the lower frame member and in turn relative to the roll mounting member.

All three components are preferably formed as an integral device with the handle member being releasably retainable by or to the main frame with the latter mounting a roll.

The frame member, in turn, includes the reciprocable severing means, as well as guide means to receive a strip from the roll and permit the same to pass over the guide means and then into contact with the applicator roll for application to a joint. Preferably, the frame member mounts the roll mounting member in a fixed position; to this end, bracket means may be provided for mounting a roll member on a shaft with the bracket means being fixedly secured to the frame.

The various components of the device of the present invention can be made from suitable materials well known to those skilled in the art, which are preferably light-weight, such as aluminum or plastic material, etc. The sizing of the various components can vary, again depending on parameters well known to those skilled in the art.

BRIEF DESCRIPTION OF THE DRAWINGS

Having thus generally described the invention, reference will now be made to the accompanying drawings, illustrating preferred embodiments, in which.

DETAILED DESCRIPTION OF PREFERRED EMBODIMENTS

Figure 1:
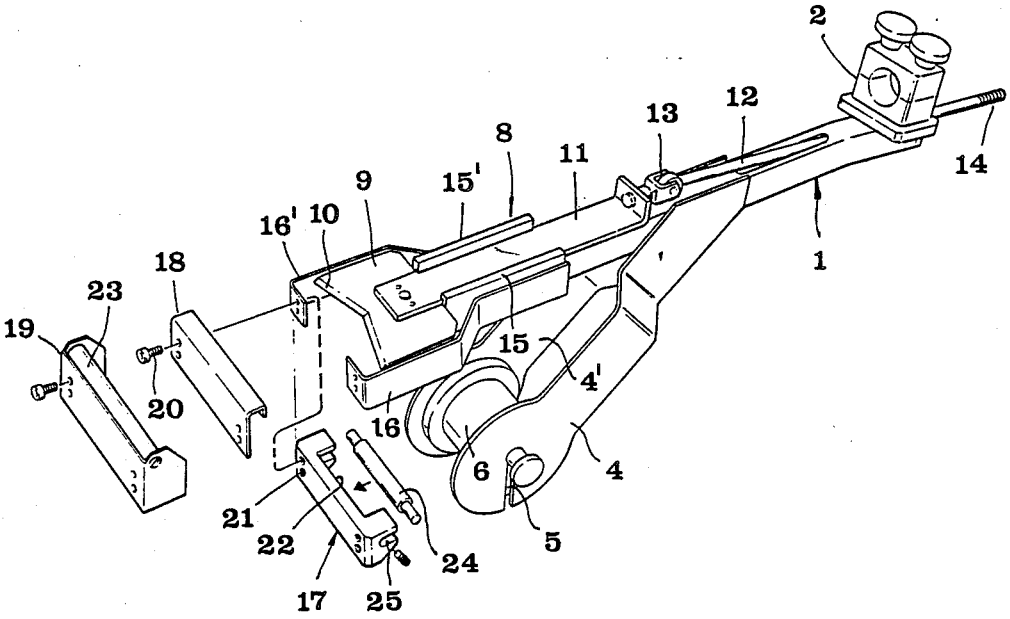
FIG. 1 is an exploded perspective view illustrating various parts of the applicator according to the invention.
Figure 2:
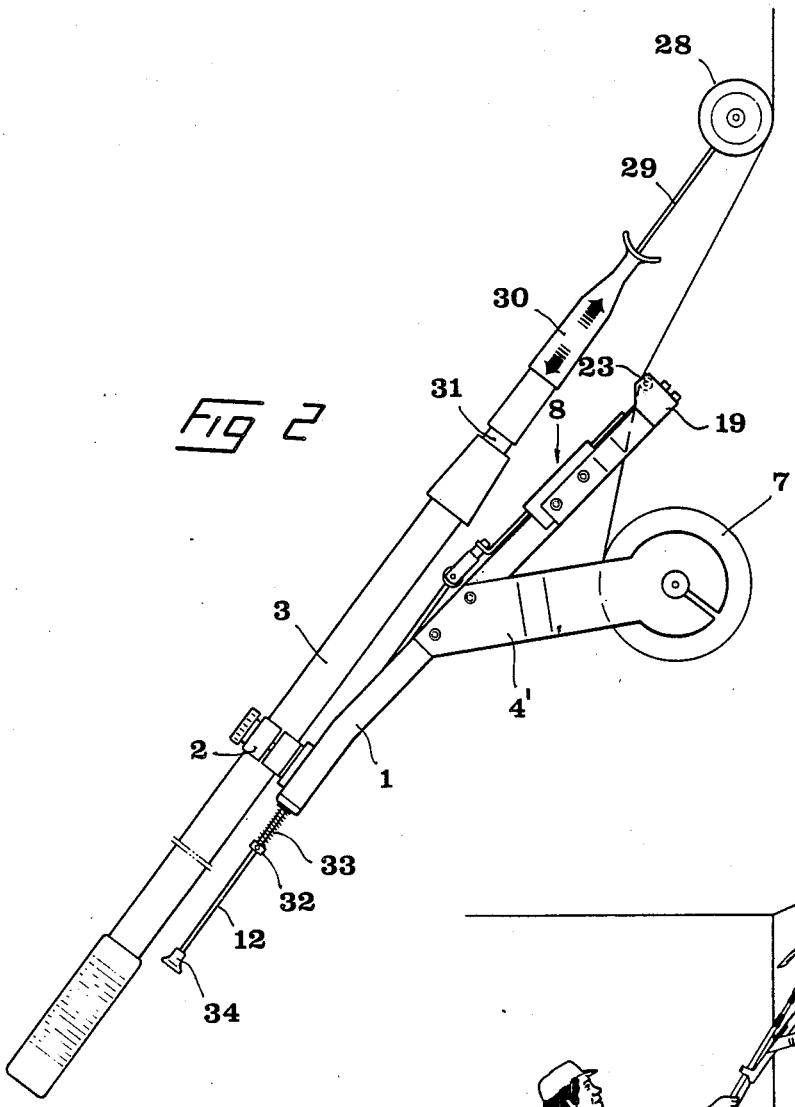
FIG. 2 is a side elevation showing the applicator attached to a main handle.

The applicator shown in FIG. 1 includes a frame generally designated 1. This frame may in practice consist of a slender box girder for instance of aluminum. At the rearward end of frame 1 an attachment 2 is provided for detachably connecting the frame to a main handle which is illustrated in FIG. 2 and designated 3. More particularly the attachment or connecting means 2 is placed on the upper side of the frame so as to locate the frame in its entirety under the main handle 3, as shown in FIG. 2. Extending downwardly and forwardly from the middle position of the frame are two arms 4,4', each arm having slots 5 for receiving an axle 6 on which a roll of strip 7 (see FIG. 2) can be received. This axle 6 can either be rotatable in itself relative to the arms or firmly connected thereto, the main point being that the strip roll 7 is capable of rotating relative to the arms.

A cutter mechanism generally designated 8 is provided which comprises a blade 9 with a leading edge 10 which has a wide V-shape. This cutting blade 9 is at its rearward end, connected to a stem member 11 which has the form of a thin plate, the rear end of member 11 being pivotally connected to an operating rod 12 by means of a link member 13. It should be noted that the rear end of rod 12 is threaded at 14 for purposes described hereinafter. The stem plate 11 is guided and held by two spaced apart flange members 15,15', which guide plate 11 along a linear path of reciprocation extending parallel to the frame.

Figure 3:
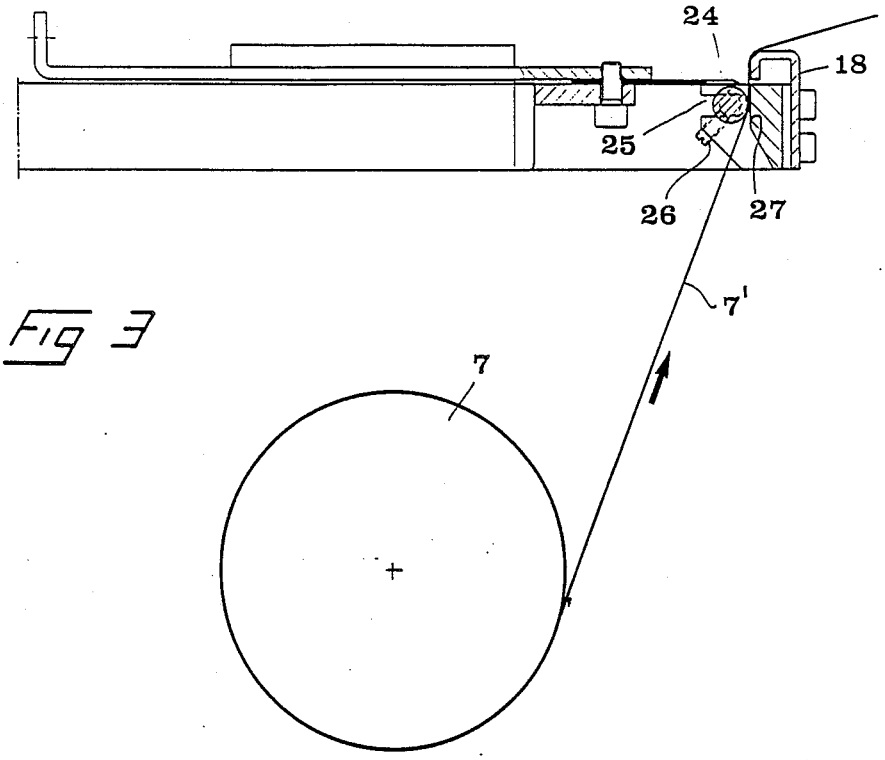
FIG. 3 is an enlarged longitudinal section through an embodiment of the applicator especially designed for dispensing a paper web.
Figure 4:
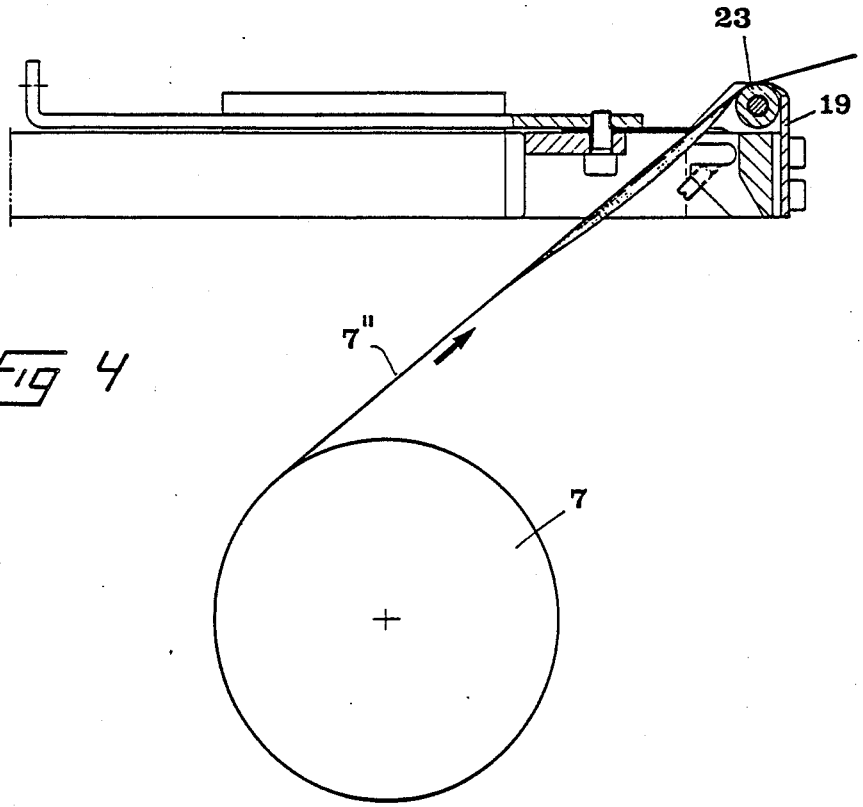
FIG. 4 is a similar section showing an embodiment for dispensing an adhesive tape.

Forwardly of the frame, two brackets 16,16' project for the purpose of supporting an edge member 17 more particularly for co-operation with either one of two different front plates 18 and 19 respectively. The edge member 17 can be connected to e.g. front plate 18 by means of screws 20 which can be inserted in threaded holes 21 in the edge member. The edge member 17 has a sharp edge 22 intended to co-operate with blade 9 for cutting a strip. Cover plate 18 is used when a paper web is to be dispensed from a roll as illustrated in FIG. 3. For this purpose the upper portion of front plate 18 is simply bent into a U-shape as shown. Cover plate 19, in turn, is intended to be used when an adhesive tape is to be dispensed as illustrated in FIG. 4. To this end, cover plate 19 includes a rotatable guide roller 23 located at the top thereof. When cover plate 18 is used for the paper web as shown in FIG. 3, a second rotatable roller 24 is mounted on edge member 17 more particularly in grooves 25 by means of 12 mount screws 26 of a special type, namely a screw which has a ball (not visible) at its front end or tip, the ball being spring loaded by a spring contained in the screw. By virtue of the fact that screws 26 extend at an acute angle to grooves 25 said balls will gently bias roller 24 against the rearward surface or abutment 27 of edge member 17. By means of this guiding and pressing roller 24, a paper web 7' dispensed from roll 7 can be properly stretched between the applicator and the joint of application on the wall despite the fact that the paper web has no adhesive on its surface. In other words, roller 24 prevents the paper web from rolling out in an uncontrolled manner from the roll when in use. Where the applicator is used for dispensing an adhesive tape 7'' (as shown in FIG. 4) there is no risk that the tape can run out from the roll in an uncontrolled manner since the tape is adhesive—more particularly on its inner surface, meaning that overlying layers of the tape roll will maintain the tape properly tensioned between the roll and the point of application on the wall. Therefore, pressing roller 24 can be removed (or not used) and front plate 18 replaced by front plate 19, the tape being simply laid over guiding roller 23.

Reference is now made to FIG. 2 illustrating an applicator roller 28 provided at its front end with an extension of main handle 3. Preferably this applicator roller 28 is rotatably mounted on a thin rod 29 which in turn is connected to a hollow handle portion 30 which in turn, can be easily mounted on and detached from a front pin 31 of the main handle 3. On operating rod 12, a collar 32 is mounted spaced from the rear end portion of frame 1, and between the collar and the end portion a pressure spring 33 is provided. Spring 33 will always urge the operating rod in a rearward direction and thus also blade 9 into a retracted, idle position in which the rear portion of the blade is in contact with the front portions of flange members 15,15'. By pushing the operating rod 12 forwardly against the action of spring 33, blade 9 will be pushed forwardly into contact and co-operation with edge 22 of member 17 so as to cut-off a strip extending between roll 7 and the guiding means of front plate 18 or 19.

Figure 5:
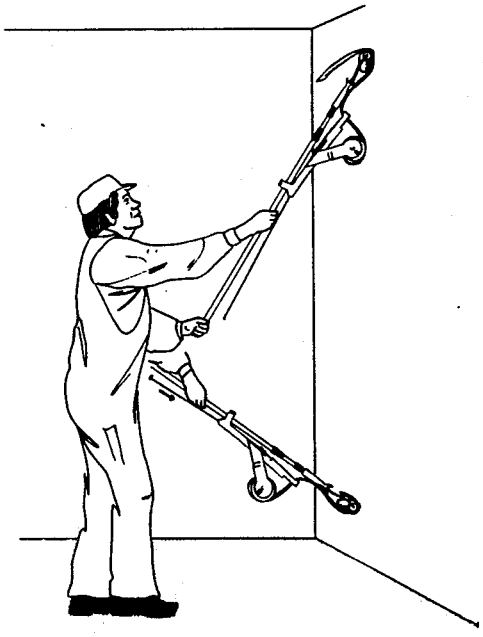
FIG. 5 is a view illustrating how the applicator of the invention may be used in practice.

By having frame 1 of the applicator entirely detachably connected to the main handle 3 by the attaching means 2, as shown, handles of different lengths can be used so as to make it possible for the operator to apply strips not only in very large and high rooms but also in small rooms having low ceilings. If a very long main handle is used, the operating rod 12 can easily be extended by adding a further rod piece or section which can be connected to threaded portion 14 after removing a handle knob 34 which is normally attached to said portion. By virtue of the fact that the guiding means, e.g. guiding roller 23 of the applicator as well as the cutting blade 9 are situated in a plane (being parallel with main handle 3) which is located between the supply roll 7 and applicator roll 28, a strip (being a paper web or an adhesive tape) can be applied to a wall in an advantageous manner in as much as the operator can start the application at the top of the wall and finish the application at the floor (FIG. 5).

When applying a paper web, as shown in FIG. 3, the web 7' is drawn out from the underside or the right side of roll 7 and passed between pressing roller 24 and abutment 27 and around top of cover plate 18 and then to the applicator roller 28, which in this case advantageously consists of sponge rubber capable of being wetted when dipped into water.

When a self-adhering tape is to be applied, as shown in FIG. 4, the tape 7'' is drawn from the upper or left side of roll 7 passing guiding roller 23 and then to applicator roller 28 which in this case may consist of any suitable hard plastic. In this way the adhesive of the tape, which is located on the inner surface of the tape in the roll, will smoothly pass the guiding roller to the applicator roller 28 which will press the tape against the wall with the adhesive facing the same. If, when starting the application, the operator needs to direct the strip precisely along the junction he may, after having initially applied the leading end of the strip, use blade 9 for keeping the strip spaced a distance from said end by gently pushing the blade towards edge member 17 without cutting off the strip, thereby catching the strip and making it possible to direct the same.

It will be understood that various modifications can be made to the above described embodiments without departing from the spirit and scope of the invention.

I claim:

1. A strip applicator for dispensing and applying a strip from a roll thereof comprising (a) a main frame (1)

(b) a spaced-apart upper handle member (3) and (c) a spaced-apart lower roll mounting member (4, 4'), said frame (1) having first means (2) for mounting said handle member (3) in a first plane displaced from said frame member (1), said frame (1) further including second means for mounting said roll mounting member in a plane displaced from and opposite to the plane of said handle member, said handle member (3) including an applicator roller (28) disposed in operative relationship at one end of said handle member (3), to said roll monting member (4, 4'), strip guiding means (18, 19) mounted by said frame (1) in operative relationship to said second mounting means, said strip guiding means (18, 19) being adapted to receive a strip (7) from a roll thereof mounted on said lower roll mounting member (4, 4') and to guide said strip (7) from said lower roll mounting member (4, 4') to and past said frame member (1) whereafter said strip (7) is adapted to be placed into juxtaposition with a joint between adjacent boards by said applicator roller (28), and severing means (8) mounted by said frame member (1) adapted to sever said strip (7) between said frame member (1) and said lower roll mounting member (4, 4'), said severing means (8) including cutting means (9) mounted for reciprocal movement relative to said frame (1) along a path substantially parallel to said frame (1).

2. The strip applicator according to claim 1 wherein said frame (1) is located between said handle member (3) and said roll mounting member (4, 4'), said frame (1) having a leading end mounting guide means (18, 19) adapted to permit passage of a strip (7) thereover between said handle means (3) and said frame means (1).

3. The strip applicator according to claim 1, wherein said severing means (8) comprises cutting means (9) mounted between said handle member (3) and said frame member (1).

4. The strip applicator according to claim 1, wherein said roll mounting member (4, 4') is mounted to said frame member (1) and includes means for mounting a roll of strip material (7) at one end thereof, said one end being spaced in a plane lower than said frame member (1).

5. A strip applicator according to claim 1, wherein said severing means (8) comprises a blade (9) having a leading edge (10), an edge member (17) and a spring (33), said blade being mounted for reciprocable movement relative to said frame (1) along a path substantially parallel to said frame (1) and between a first idle position in which said blade (9), by means of said spring (33), is retracted and spaced from said edge member (17), to thereby allow free feeding of said strip (7) from said roll to said guiding means (15, 15'), and a second forward position in which said forward edge (10) of said blade (9) is moved into contact with said edge member (17) so as to cut off said strip (7), said cutter means (8) having control means (12) extending generally parallel to said handle (3) and rearwardly of said frame (1) whereby said cutting blade (9) may be displaced from said idle position towards said edge member (17) against the action of said spring (33).

6. A strip applicator according to claim 1, wherein said severing means (8) includes guide means (15, 15') for guiding said strip (7) from a roll mounted on said roll mounting member (4, 4') beyond a leading end of said main frame (1).

7. A strip applicator according to claim 6, wherein said guide means (15, 15') includes a front plate (19) detachably mounted to said frame (1), said front plate (19) including means for supporting a rotatable roller (23) adapted to guide a strip of an adhesive tape (7").

8. The strip applicator according to claim 5, wherein said edge member (17) includes a second rotatable roller (24), an abutment (27) and spring means (33) whereby said spring means (33) biases said roller (24) against said abutment (27), said abutment (27) forming part of said edge member (17) whereby a strip (7) in the form of a web from said roll may be pressed against said abutment (27).

9. A strip applicator for dispensing and applying a strip from a roll of the same comprising:

(a) an elongated frame (1) having means (2) for connecting the same to an elongated handle (3), one end of which is added to be held by an operator and the opposite end of which includes means (29,30,31) for holding an applicator roller (28) for rolling and pressing the strip, during use, into a position for covering a joint between adjacent boards, said connecting means (2) positioning said frame in the area beneath said handle (3), (b) means (4,4') for supporting a shaft (6) in an area under said frame (1), which is adapted to mount a roll of strip (7) and for permitting rotation of the same, (b) means (18,19) for guiding said strip from said roll (7) past a forward end of said frame (1) to said applicator roller (28), and (c) a cutting means (8) comprises a blade (9) having a leading edge (10), an edge member (17) and a spring (33), said blade being mounted for reciprocable movement relative to said frame along a path substantially parallel to said frame and between a first idle position in which said blade, by means of a spring (33), is retracted and spaced from an edge member (17), to allow free feeding of said strip from said roll to said guiding means, and a second forward position in which a forward edge (10), of said blade is moved into contact with said edge member (17) so as to cut off said strip, said cutter mechanism further including an operating rod (12) extending generally parallel to said handle (3) and rearwardly of said frame (1) whereby said cutting blade may be moved from said idle position towards said edge member against the action of said spring (33).

10. The strip applicator according to claim 9, wherein said guiding means includes a front plate (19) detachably mounted on said frame and supporting a rotatable roller (23) for guiding a strip in the form of an adhesive tape (7").

11. The strip applicator according to claim 9, wherein said edge member (17) includes a second rotatable roller (24) an abutment (27) and spring means whereby said spring means biases said roller against said abutment (27), said abutment forming part of said edge member so as to press a strip in the form of a web from said roll against said abutment.

* * * * *